US009168650B2

(12) United States Patent
Itakura et al.

(10) Patent No.: US 9,168,650 B2
(45) Date of Patent: Oct. 27, 2015

(54) OSCILLATING ROTARY ELECTRIC POWER TOOL

(71) Applicant: MAKITA CORPORATION, Anjo-shi, Aichi (JP)

(72) Inventors: Toru Itakura, Anjo (JP); Shin Nakamura, Anjo (JP); Takayuki Tahara, Anjo (JP); Akira Mizutani, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 511 days.

(21) Appl. No.: 13/749,185

(22) Filed: Jan. 24, 2013

(65) Prior Publication Data

US 2013/0220659 A1 Aug. 29, 2013

(30) Foreign Application Priority Data

Feb. 24, 2012 (JP) ..... 2012-038864

(51) Int. Cl.

| | |
|---|---|
| ***B25F 5/00*** | (2006.01) |
| ***B24B 23/04*** | (2006.01) |
| ***B24B 47/16*** | (2006.01) |

(52) U.S. Cl.

CPC . *B25F 5/00* (2013.01); *B24B 23/04* (2013.01); *B24B 47/16* (2013.01); *B25F 5/006* (2013.01)

(58) Field of Classification Search

CPC ..... B25F 3/00; B25F 5/00; B24B 7/00

USPC ..... 173/213, 217, 216; 30/392; 451/356

See application file for complete search history.

(56) References Cited

U.S. PATENT DOCUMENTS

| | | | | |
|---|---|---|---|---|
| 5,199,223 | A * | 4/1993 | Rudolf et al. | 451/342 |
| 7,753,135 | B2 * | 7/2010 | Lennartz | 173/109 |
| 2004/0178686 | A1 | 9/2004 | Peterreins | |
| 2005/0224245 | A1 | 10/2005 | Kamimura et al. | |
| 2009/0320625 | A1 | 12/2009 | Kildevaeld | |

FOREIGN PATENT DOCUMENTS

| | | | |
|---|---|---|---|
| DE | 20 2013 001 125 | U1 | 4/2013 |
| GB | 1 203 229 | | 8/1970 |
| GB | 2 434 764 | A | 8/2007 |
| JP | U-49-111654 | | 9/1974 |
| JP | 2005-207549 | A | 8/2005 |
| JP | A-2010-148484 | | 7/2010 |
| JP | 2011-230204 | A | 11/2011 |

OTHER PUBLICATIONS

May 30, 2013 Search Report issued in Great Britain Patent Application No. GB1301341.2.

May 26, 2015 Office Action issued in Japanese Patent Application No. 2012-038864.

* cited by examiner

*Primary Examiner* — Hemant M Desai

*Assistant Examiner* — Nathaniel Chukwurah

(74) *Attorney, Agent, or Firm* — Oliff PLC

(57) ABSTRACT

An oscillating rotary electric power tool, in which a spindle with a distal end tool attached thereto is projected downward from a front end portion of a housing accommodating a motor, and the housing also accommodates a coupling member rotatable integrally with an output shaft of the motor, a crankshaft fitted with the coupling member in a depression and projection fitting structure, and a link member to which the spindle is fixed and power is transmitted from the crankshaft to rotate clockwise and counterclockwise in an oscillating manner so that the link member will be driven by the motor to rotate the spindle clockwise and counterclockwise in the oscillating manner, wherein an elastic body is interposed between the coupling member and the crankshaft in the same axial direction as the output shaft.

11 Claims, 4 Drawing Sheets

OSCILLATING ROTARY ELECTRIC POWER TOOL

BACKGROUND OF THE INVENTION

This application claims the benefit of Japanese Patent Application Number 2012-038864 filed on Feb. 24, 2012, the entirety of which is incorporated by reference.

1. Technical Field

This invention relates to an oscillating rotary electric power tool in which a spindle with a distal end tool attached thereto is projected downward from a front end portion of a housing accommodating a motor so that the spindle will be driven by the motor to rotate clockwise and counterclockwise in an oscillating manner.

2. Background Art

As shown in FIG. 4, there is known a conventional oscillating rotary electric power tool 50, where a motor M is accommodated in a housing 51 extending in a longitudinal direction (horizontal direction of FIG. 4) of the oscillating rotary electric power tool 50, and a spindle 53 to which various kinds of distal end tools 52 are able to be attached is projected downward from a front end portion (right side in FIG. 4) of the housing 51 in an orthogonal direction with respect to the longitudinal axis of the housing 51. In this oscillating rotary electric power tool 50, a coupling member 55 is coupled in front of an output shaft 54 of the motor M in such a manner that a projected portion 58 of a crankshaft 57 is fitted in a depressed portion 56 provided on a front end face of this coupling member 55 to integrate the coupling member 55 and the crankshaft 57 in the rotational direction. Then, a link member 59 to which the spindle 53 is fixed is supported in front of the crankshaft 57 within the housing 51. As viewed from the front side of the oscillating rotary electric power tool 50, this link member 59 rotates clockwise and counterclockwise in an oscillating manner by the transmission of power from the crankshaft 57.

In the above oscillating rotary electric power tool 50, when the output shaft 54 of the motor M rotates, the link member 59 rotates clockwise and counterclockwise in a oscillating manner as a result of the transmission of the torque of the motor M to the link member 59 through the coupling member 55 and the crankshaft 57. Along with this, the spindle 53 fixed to the link member 59 and a distal end tool 52 rotate clockwise and counterclockwise in the oscillating manner. However, since the projected portion 58 is fitted in the depressed portion 56 with an allowance in the rotational direction, the depressed portion 56 and the projected portion 58 hit each other when the coupling member 55 and the crankshaft 57 rotate integrally along with the rotation of the output shaft 54, suffering from the disadvantage of generating abnormal noise in a hitting portion.

As a technique for preventing the generation of such abnormal noise, Japanese Utility Model Application Publication No. 49-111654 describes that projected portions and depressed portions are formed alternately in a circumferential direction on the end face of a cylindrical driving body and the end face of a cylindrical driven body facing each other, respectively. The projected portions of the driving body are fit into the depressed portions of the driven body and the projected portions of the driven body are fit into the depressed portions of the driving body, and an elastic body is inserted into a clearance gap between each projected portion and each depressed portion in the circumferential direction.

SUMMARY OF THE INVENTION

However, like in the technique described in Japanese Utility Model Application Publication No. 49-111654 to prevent the generation of abnormal noise, when an elastic body is inserted between the depressed portion 56 and the projected portion 58 in the circumferential direction of the coupling member 55, a force to squash the elastic body is applied from the projected portion 58 in the rotational direction along with the rotation of the output shaft 54. In such a case, since the elastic body can be torn off by this force, it is hard to say that the durability of the elastic body is sufficient.

This invention is proposed in view of such circumstances, and it is an object thereof to provide an oscillating rotary electric power tool for satisfying both improvement in durability and prevention of the generation of abnormal noise.

An oscillating rotary electric power tool according to a first aspect of the present invention includes a housing provided to extend in a longitudinal direction, a motor accommodated in the housing, a spindle projected downward from a front end portion of the housing, a distal end tool to be attached to the spindle, a coupling member accommodated in the housing and coupled to an output shaft of the motor on an identical axis to that of the output shaft to be rotatable integrally with the output shaft, a crankshaft accommodated in the housing, arranged to be rotatable on the identical axis, and fitted with the coupling member in a depression and projection fitting structure, and a link member accommodated in the housing, to which the spindle is fixed and power is transmitted from the crankshaft to rotate clockwise and counterclockwise in an oscillating manner. In the oscillating rotary electric power tool, the link member is driven by the motor through the coupling member and the crankshaft to rotate the spindle to clockwise and counterclockwise in the oscillating manner, and an elastic body is interposed between the coupling member and the crankshaft in a direction of the identical axis to fit the coupling member and the crankshaft together in the depression and projection fitting structure.

According to a second aspect of the present invention, in the first aspect, a depressed portion is formed in either an end face of the coupling member or an end face of the crankshaft facing each other in the identical axial direction, and a projected portion is formed on the other end to project from the end face in the identical axial direction to fit in the depressed portion in the depression and projection fitting structure, and the elastic body is interposed between the end face on an open side of the depressed portion and the end face on a base end side of the projected portion.

According to a third aspect of the present invention, in the second aspect, the depressed portion is formed in the end face of the coupling member and the projected portion is formed on the end face of the crankshaft.

According to a fourth aspect of the present invention, in the second aspect, the elastic body is an O-ring mounted on an outer circumference of a base end of the projected portion.

According to the oscillating rotary electric power tool according to the first aspect of the invention, the elastic body elastically deforms between the coupling member and the crankshaft in the direction of the identical axis to that of the output shaft of the motor so that the elastic body can adhere to the coupling member and the crankshaft. Therefore, as a result of increasing the resistance by the elastic body in the rotational direction of the coupling member or the rotational direction of the crankshaft, the unity between the coupling member and the crankshaft in the rotational direction is increased. Thus, it is possible to prevent the generation of abnormal noise caused by hitting of the coupling member and the crankshaft.

In addition, the elastic body just deforms elastically to adhere to the coupling member and the crankshaft, and no force to squash the elastic body is applied to the elastic body in the rotational direction during the rotation of the coupling member or the rotation of the crankshaft. Since the elastic body is not squashed and torn off, the durability of the elastic body can be improved.

According to the second aspect of the invention, the elastic body is sandwiched between the end face on the open side of the depressed portion and the end face on a base end side of the projected portion to so that both end faces can be easily adhered. Thus, the resistance between both end faces increases in the rotational direction of the coupling member or the rotational direction of the crankshaft.

According to the third aspect of the invention, the depressed portion is formed in the end face of the coupling member to provide two portions having projected cross-sections in the end portion of the coupling member. The weights of the two portions make the weight of the coupling member heavier than the weight of the crankshaft having one projected portion. Thus, it is possible to make the strength of the coupling member stronger than the strength of the crankshaft driven by the coupling member to move.

According to the fourth aspect of the present invention, there is no need to create an additional space for the elastic body between the coupling member and the crankshaft. Furthermore, if a commercially available O-ring is used for the elastic body, the elastic body can be formed at low cost.

DETAILED DESCRIPTION OF THE EMBODIMENTS

Figure 1:
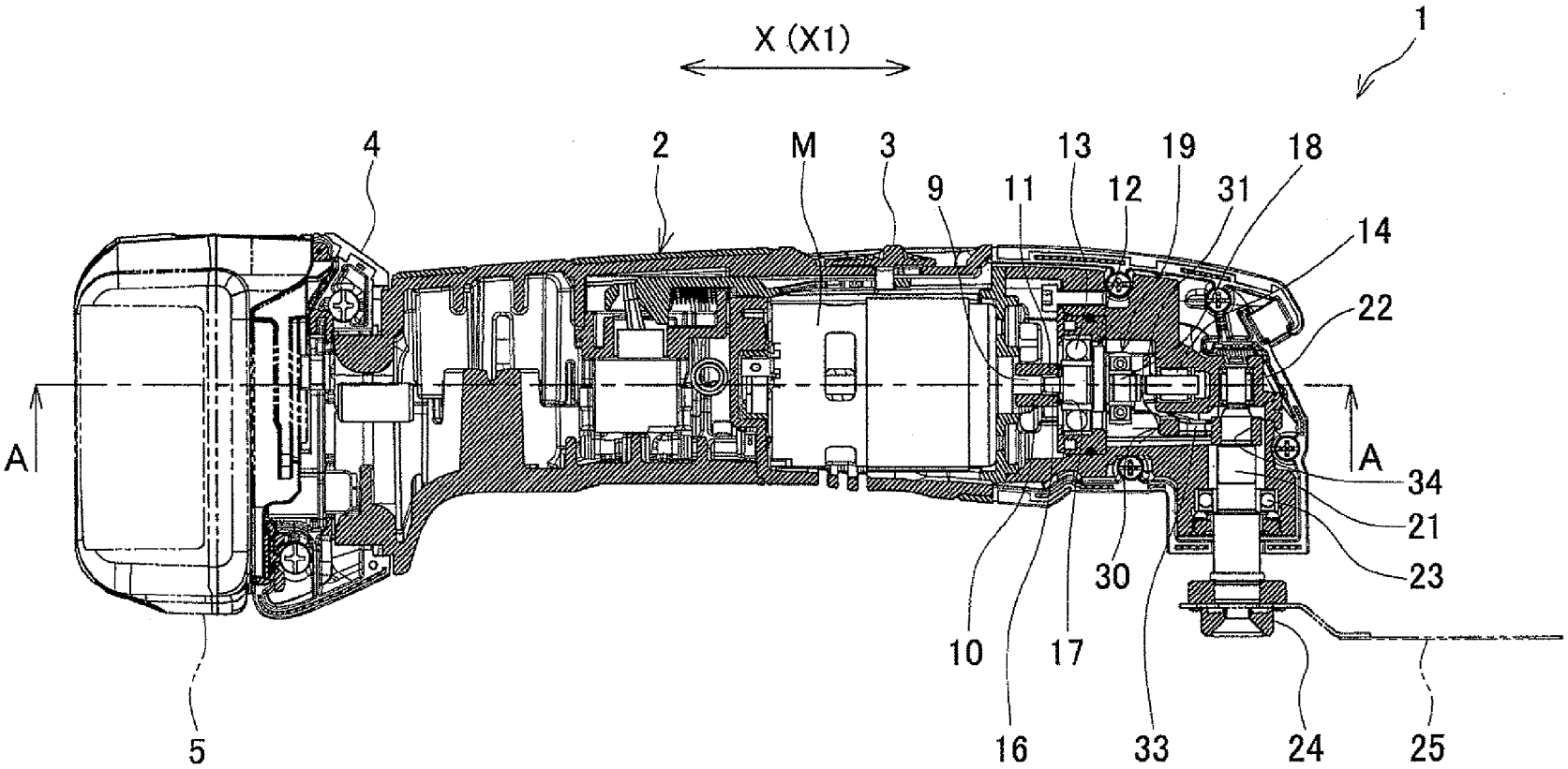
FIG. 1 is a sectional side view of an oscillating rotary electric power tool according to an embodiment of the present invention.

An embodiment of the present invention will be described with reference to FIG. 1 to FIG. 3. An oscillating rotary electric power tool 1 shown in FIG. 1 and FIG. 2 includes a housing 2, which is molded with resin, has a round cross-section, and extends in the longitudinal direction (horizontal direction in FIG. 1 and FIG. 2) of the oscillating rotary electric power tool 1. A motor M is accommodated inside the housing 2, and a slide lever 3 (see FIG. 1) is provided on the outer circumference of the housing 2 to switch the motor M between an on-state and an off-state. Further, a battery attachment portion 4 is provided in a rear end portion of the housing 2 (left side of FIG. 1 and FIG. 2). A battery pack 5 is removably attached to the battery attachment portion 4 to feed power to the motor M when the slide lever 3 is switched to the on-state.

Figure 2:
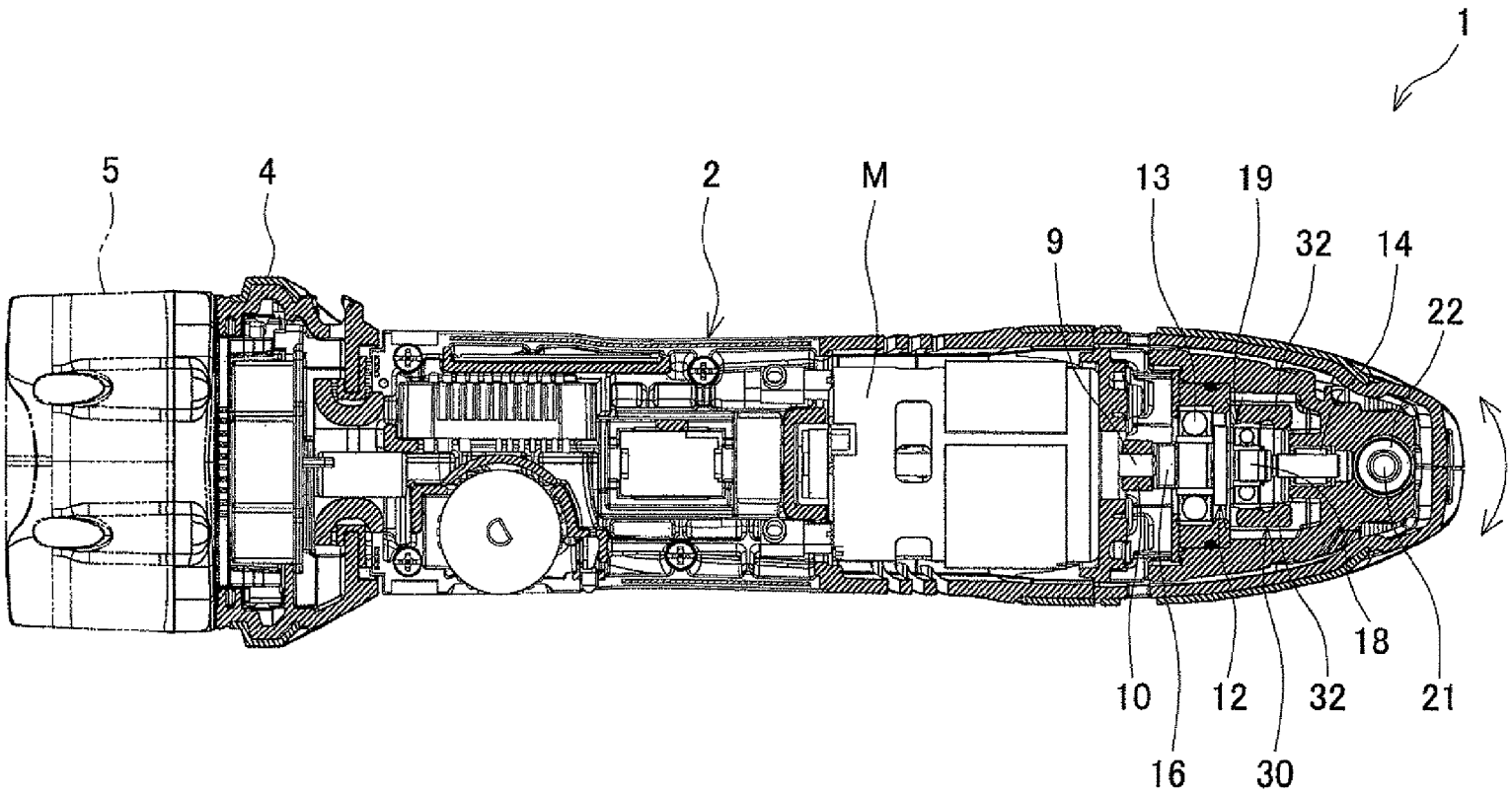
FIG. 2 is a sectional view taken along the line A-A in FIG. 1.

As shown in FIG. 1 and FIG. 2, a cylindrical coupling member 10 is concentrically coupled to an output shaft 9 in front of the output shaft 9 of the motor M inside the housing 2. Here, the output shaft 9 is pressed into the coupling member 10. This allows the coupling member 10 to rotate integrally with the output shaft 9. A depressed portion 11 having a bottom and extending in the axial direction of the output shaft 9 is opened up in the front end face of this coupling member 10. Further, a crankshaft 12 is rotatably supported within the housing 2 through bearings 13 and 14 on the same axis as the output shaft 9 in front of the coupling member 10. Thus, the front end face of the coupling member 10 faces a rear end face 15 (see FIG. 3) of the crankshaft 12 in the same axial direction X as the axis of the output shaft 9. Then, a projected portion 16 projecting toward the depressed portion 11 in the same axial direction X is formed integrally on this rear end face 15. An O-ring 17 made of rubber is mounted on the outer circumference of a base end of this projected portion 16 as shown in FIG. 1 and FIG. 3. It should be noted that the O-ring 17 is not shown in FIG. 2. This O-ring 17 is an example of an elastic body of the present invention.

The projected portion 16 and the depressed portion 11 are fitted together with an allowance in the rotational direction of the coupling member 10 to fit the crankshaft 12 and the coupling member 10 together in a depression and projection fitting structure. In this depression and projection fitting state, as shown in FIG. 1, the O-ring 17 is interposed between the front end face of the coupling member 10 and the rear end face 15 of the crankshaft 12 located on the base end side of the projected portion 16 in the same axial direction X. The O-ring 17 is sandwiched between the front end face and the rear end face 15, elastically deforming in the same axial direction X. This makes the O-ring 17 adhere to the front end face and the rear end face 15. It should be noted that the front end face of the coupling member 10 is an example of an end face on the open side of the depressed portion in the present invention. Further, the rear end face 15 of the crankshaft 12 is an example of an end face on the base end side of the projected portion in the present invention.

Figure 3:
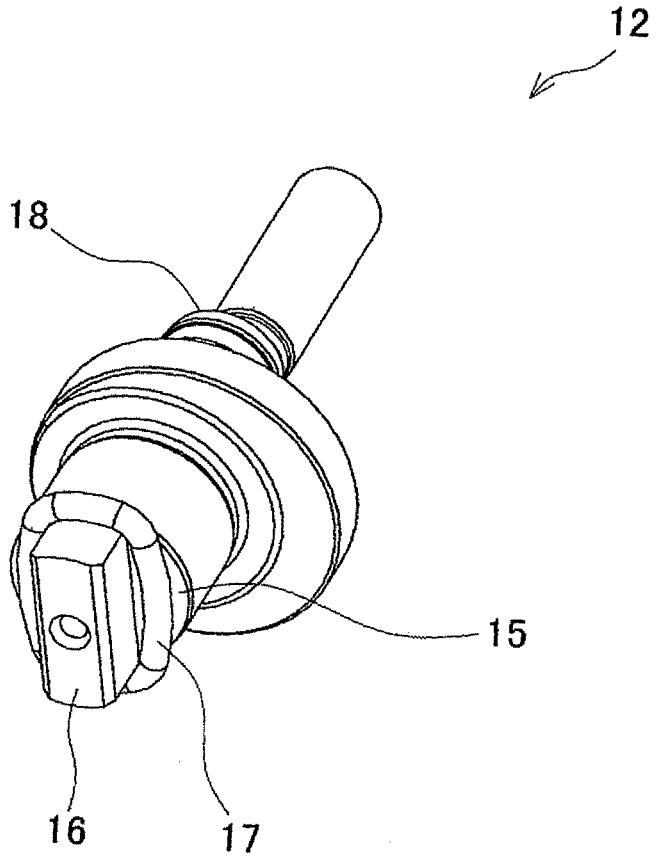
FIG. 3 is a perspective view showing a state in which an O-ring is mounted around a projected portion of a crankshaft included in the oscillating rotary electric power tool.
Figure 4:
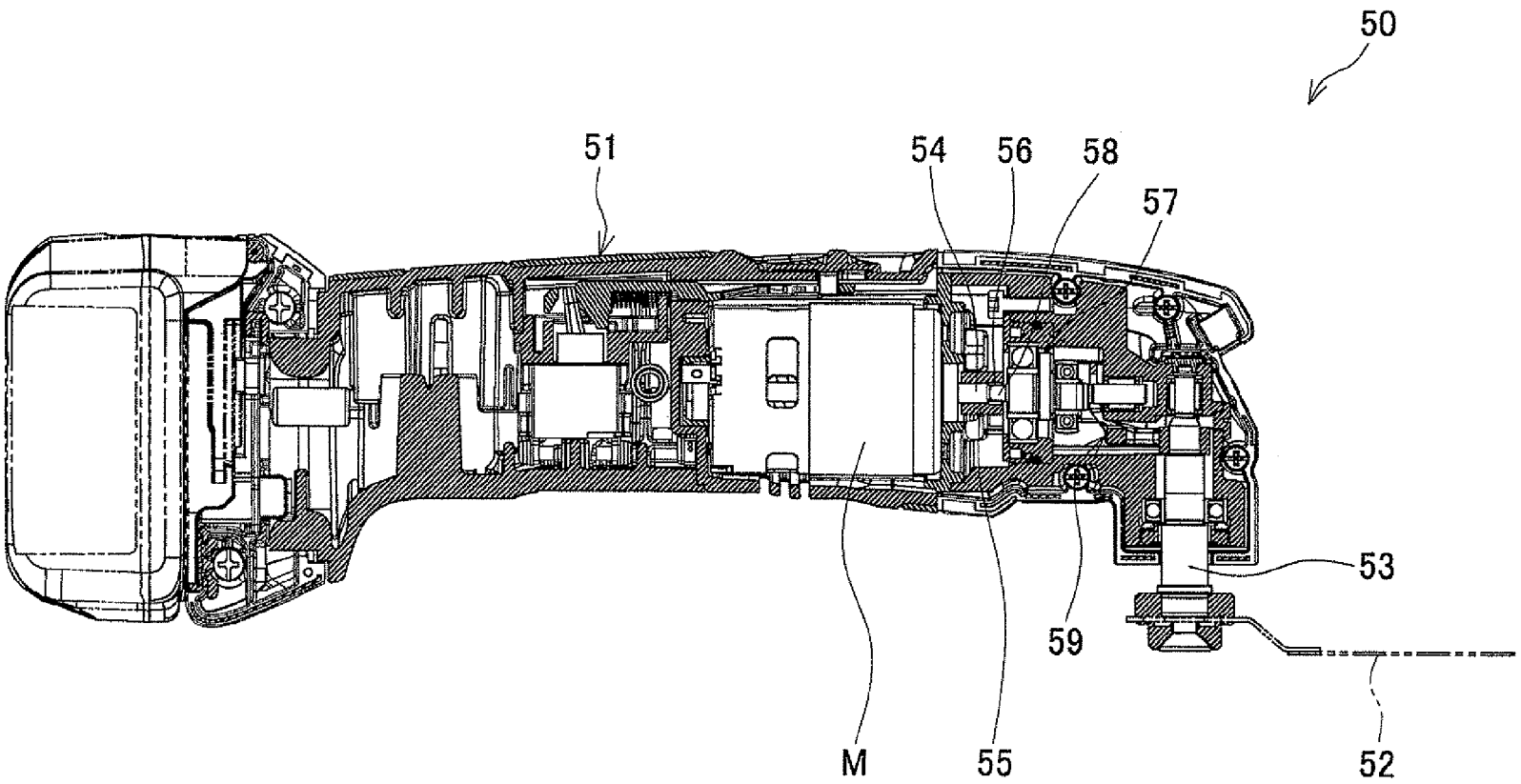
Prior Art FIG. 4
FIG. 4 is a sectional side view of a conventional oscillating rotary electric power tool.

Further, as shown in FIG. 1 and FIG. 3, an eccentric-shaft portion 18 extending in the axial direction X1 from a position eccentric to the shaft center of the crankshaft 12 is formed in a substantially central portion of the crankshaft 12 in the axial direction X1. A bearing 19 (see FIG. 1) with an arc-like outer ring is assembled externally around this eccentric-shaft portion 18.

Further, as shown in FIG. 1, in the front end portion of the housing 2, a spindle 21 is supported within the housing 2 through bearings 22 and 23, and the distal end of the spindle 21 projects downward of the housing 2. Any of various kinds of distal end tools different in shape and intended use, such as a cutting tool and a grinding tool, is fixable at the distal end of the spindle 21 with a bolt 24. FIG. 1 shows an example where a cutting tool 25 of which the planer view is fan-shaped is fixed to the spindle 21.

In addition, as shown in FIG. 1 and FIG. 2, a link member 30 is supported between the crankshaft 12 and the spindle 21 in the longitudinal direction within the housing 2. The link member 30 includes a ring-shaped main body part 31, a pair of engaging parts 32, 32, and an arm part 33. The main body part 31 is placed face to face with the eccentric-shaft portion 18, and the front end side of the crankshaft 12 is inserted through the main body part 31 as shown in FIG. 1. The pair of engaging parts 32, 32 are provided to project from the main body part 31 into the eccentric-shaft portion 18 side and arranged to be parallel to each other on the outside of the crankshaft 12 as shown in FIG. 2. The bearing 19 is placed in a space between the engaging parts 32, 32 as shown in FIG. 2. The arm part 33 is provided to project from the main body part 31 into the spindle 21 side, and a spindle positioning hole 34 (see FIG. 1) is formed in the arm part 33. The spindle 21 is pressed into the spindle positioning hole 34.

Next, as an example, an action of using the oscillating rotary electric power tool 1 to cut a column material installed on the floor in a standing manner will be described. A user switches the slide lever 3 to the on-state while holding the housing 2 to drive the motor M. When the coupling member 10 rotates together with the output shaft 9 of the motor M, the rotation of the motor M is transmitted to the crankshaft 12 fitted with the coupling member 10 in the depression and projection fitting structure. Along with this, when the crankshaft 12 rotates integrally with the coupling member 10, the bearing 19 assembled, around the eccentric-shaft portion 18 eccentrically rotates about the crankshaft 12. During the eccentric rotation, the bearing 19 repeats motion to come into contact with the engaging parts 32, 32 of the link member 30 only to right and left so that the link member 30 will rotate clockwise and counterclockwise in an oscillating manner as viewed from the front side of the oscillating rotary electric power tool 1 as indicated by the arrow in FIG. 2. As a result, the spindle 21 and the cutting tool 25 rotate clockwise and counterclockwise in an oscillating manner about the axis of the spindle 21. Then, the cutting tool 25 rotating in the oscillating manner is pressed against the column material while the spindle 21 is kept perpendicular to the floor to cut the column material.

Conventionally, when the coupling member 10 and the crankshaft 12 rotate integrally, since the projected portion 16 of the crankshaft 12 moves in the rotational direction within the depressed portion 11 of the coupling member 10, the depressed portion 11 and the projected portion 16 hit each other, suffering from the disadvantage of generating abnormal noise in the hitting portion. To prevent this, in the embodiment, the O-ring 17 (see FIG. 1 and FIG. 3) is interposed between the front end face of the coupling member 10 and the rear end face 15 (see FIG. 3) of the crankshaft 12. This O-ring 17 is sandwiched between the front end face and the rear end face 15, elastically deforming in the same axial direction X (see FIG. 1). This makes the O-ring 17 adhere to the front end face and the rear end face 15, resulting in increases in resistance in the rotational direction of the coupling member 10 and the rotational direction of the crankshaft 12. Therefore, the unity between the coupling member 10 and the crankshaft 12 in the rotational direction is increased to prevent the projected portion 16 from moving in the rotational direction within the depressed portion 11, preventing the depressed portion 11 and the projected portion 16 from hitting each other. Thus, it is possible to prevent the generation of abnormal noise.

Further, when the output shaft 9 of the motor M accommodated in the housing 2 has a backlash in the axial direction, the output shaft 9 and the coupling member 10 shake during the operation of the oscillating rotary electric power tool 1, and this is considered to be the cause of abnormal noise. In the embodiment, the front end face of the coupling member 10 coupled to the output shaft 9 is struck against the rear end face 15 of the crankshaft 12 in such a state that there is no clearance gap in the axial direction of the output shaft 9 through the O-ring 17. Thus, the coupling member 10 and the output shaft 9 are prevented from moving in the axial direction during the operation of the oscillating rotary electric power tool 1. As a result, it is possible to prevent the generation of abnormal noise due to a backlash.

Effect of the Embodiment

In the oscillating rotary electric power tool 1 of the embodiment, the O-ring 17 elastically defouns between the coupling member 10 and the crankshaft 12 in the same axial direction X as the axis of the output shaft 9 to allow the coupling member 10 and the crankshaft 12 to adhere to each other. Therefore, as a result of increasing the resistance by the O-ring 17 in the rotational direction of the coupling member 10 and the rotational direction of the crankshaft 12, the unity between the coupling member 10 and the crankshaft 12 in the rotational direction is increased. Thus, it is possible to prevent the generation of abnormal noise caused by hitting of the coupling member 10 and the crankshaft 12.

In addition, the O-ring 17 just deforms elastically to adhere to the coupling member 10 and the crankshaft 12, and no force to squash the O-ring 17 is applied to the O-ring 17 in the rotational direction during the rotation of the coupling member 10 and the rotation of the crankshaft 12. Thus, since the O-ring 17 is not squashed and torn off, the durability of the O-ring 17 can be improved.

Further, the O-ring 17 is interposed and sandwiched between the front end face of the coupling member 10 and the rear end face 15 of the crankshaft 12 so that the two end faces can be easily adhered. Thus, the resistance between the two end faces increases in the rotational direction of the coupling member 10 and the rotational direction of the crankshaft 12.

Further, in the embodiment, the depressed portion 11 is opened up in the front end face of the coupling member 10, and the projected portion 16 to be fitted in the depressed portion 11 is formed on the rear end face 15 of the crankshaft 12. Therefore, two portions having projected cross-sections are provided in the front end portion of the coupling member 10. The weights of the two portions make the weight of the coupling member 10 heavier than the weight of the crankshaft 12 having the one projected portion 16. Thus, it is possible to make the strength of the coupling member 10 stronger than the strength of the crankshaft 12 driven by the coupling member 10 to move.

In addition, since the O-ring 17 is mounted on the outer circumference of the base end of the projected portion 16 formed on the crankshaft 12, there is no need to create an additional space for the O-ring 17 between the coupling member 10 and the crankshaft 12. Furthermore, since a commercially available O-ring is used for the O-ring, there is an advantage that the O-ring is cheap.

It should be noted that the present invention is not limited to the aforementioned embodiment, and part of the structure can be changed without departing from the spirit and scope of the invention. For example, unlike the aforementioned embodiment, the structure may be such that a depressed portion is opened up in the rear end face 15 of the crankshaft 12 and a projected portion to be fitted in the depressed portion is formed on the front end face of the coupling member 10 to fit the coupling member 10 and the crankshaft 12 together in a depression and projection fitting structure. The O-ring 17 may also be made of resin, rather than of rubber. Further, although the aforementioned embodiment illustrates an example of applying the present invention to a rechargeable oscillating rotary electric power tool, it is not limited thereto and the present invention may also be applied to an AC-driven oscillating rotary electric power tool.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. An oscillating rotary electric power tool comprising:
a housing provided to extend in a longitudinal direction;
a motor accommodated in the housing;

a spindle projected downward from a front end portion of the housing;

a distal end tool to be attached to the spindle;

a coupling member accommodated in the housing and coupled to an output shaft of the motor on an identical axis to that of the output shaft to be rotatable integrally with the output shaft;

a crankshaft accommodated in the housing, arranged to be rotatable on the identical axis, and fitted with the coupling member in a depression and projection fitting structure; and a link member accommodated in the housing, to which the spindle is fixed and power is transmitted from the crankshaft to rotate clockwise and counterclockwise in an oscillating manner, wherein the link member is driven by the motor through the coupling member and the crankshaft to rotate the spindle clockwise and counterclockwise in the oscillating manner, and an elastic body is interposed between the coupling member and the crankshaft in a direction of the identical axis to fit the coupling member and the crankshaft together in the depression and projection fitting structure.

2. The oscillating rotary electric power tool according to claim 1, wherein a depressed portion is formed in either an end face of the coupling member or an end face of the crankshaft facing each other in the identical axial direction, and a projected portion is formed on the other end face to project from the end face in the identical axial direction to fit in the depressed portion in the depression and projection fitting structure, and the elastic body is interposed between the end face on an open side of the depressed portion and the end face on a base end side of the projected portion.

3. The oscillating rotary electric power tool according to claim 2, wherein the depressed portion is formed in the end face of the coupling member and the projected portion is formed on the end face of the crankshaft.

4. The oscillating rotary electric power tool according to claim 2, wherein the elastic body is an O-ring mounted on an outer circumference of a base end of the projected portion.

5. The oscillating rotary electric power tool according to claim 4, wherein the O-ring is made of rubber.

6. The oscillating rotary electric power tool according to claim 4, wherein the O-ring is made of resin.

7. The oscillating rotary electric power tool according to claim 1, wherein a battery attachment portion to which a battery pack is attached is provided in a rear end portion of the housing to feed power to the motor.

8. The oscillating rotary electric power tool according to claim 1, wherein any of distal end tools different in intended use is attachable to the spindle.

9. The oscillating rotary electric power tool according to claim 8, wherein the distal end tool is a cutting tool.

10. The oscillating rotary electric power tool according to claim 9, wherein the cutting tool is fan-shaped in a planer view.

11. The oscillating rotary electric power tool according to claim 8, wherein the distal end tool is a grinding tool.

* * * * *